United States Patent [19]

Schergen et al.

[11] 4,360,854

[45] Nov. 23, 1982

[54] DEMAGNETIZING, VARIABLE FREQUENCY

[75] Inventors: Mark Schergen, Des Plaines; Joseph A. Armond, River Forest, both of Ill.

[73] Assignee: Electro-Matic Products Co., Chicago, Ill.

[21] Appl. No.: 215,569

[22] Filed: Dec. 12, 1980

[51] Int. Cl.[3] ..... H01F 13/00

[52] U.S. Cl. ..... 361/149; 361/267

[58] Field of Search ..... 361/149, 267

[56] References Cited

U.S. PATENT DOCUMENTS

| | | | |
|---|---|---|---|
| Re. 25,607 | 6/1964 | Littwin | 361/149 |
| 2,946,932 | 7/1960 | Littwin | 361/149 |
| 3,368,119 | 2/1968 | Littwin | 361/149 |
| 3,579,053 | 5/1971 | Littwin | 361/149 |
| 3,626,255 | 12/1971 | Littwin | 361/149 |
| 4,158,873 | 6/1979 | Schroeder et al. | 361/267 |

FOREIGN PATENT DOCUMENTS

| | | | |
|---|---|---|---|
| 2211566 | 9/1973 | Fed. Rep. of Germany | 361/149 |

*Primary Examiner*—J. D. Miller

*Assistant Examiner*—L. Schroeder

*Attorney, Agent, or Firm*—Paul H. Gallagher

[57] ABSTRACT

A pair of demagnetizing coils, or more than two, and the article to be demagnetized is put in the coils. The demagnetizing is done by reversing the polarity in a series of steps in a cycle, and the current reduced in successive steps, to a point at or near zero. The cycle can be varied as to time period, and the number of steps within a cycle varied. The applied initial voltage can be adjusted or predetermined as to maximum value, with corresponding current values, and the number of steps predetermined within the cycle independently of the maximum voltage. The apparatus can be set in manual mode, wherein the cycle timer period and number of steps can be independently set, and to automatic mode, wherein the cycle time and number of steps are directly correlated. The polarity of the applied magnetic field is counter to that of the magnetized article, in the initial step, and additional resistances utilized in establishing greater or lesser magnitude of the magnetic field in the demagnetizing coils according to the initial polarity of the magnetized piece.

11 Claims, 8 Drawing Figures

MED
SOFT
HARD
MAN
AUTO
R
G

DEMAGNETIZING, VARIABLE FREQUENCY

FIELD OF THE INVENTION

The invention resides in demagnetizing in the industrial field. The manufacture of many items, magnetization becomes a big factor, and in finalizing the end products, it is desired that all magnetization be done away with. Magnetization comes into play in different ways, both deliberately and incidentally. It occurs deliberately, for example, in the case of a machining operation on a workpiece, where the workpiece is held in place by a magnetic chuck which magnetizes it. It occurs incidentally in the working of iron or steel, as in rolling it or otherwise treating it. In any case, it is desired to demagnetize the pieces or parts.

The apparatus and method of the invention utilizes the basic concept of demagnetizing which utilizes applying successively decreasing magnetizing forces, in successively opposite directions, until the magnetism in the subject piece is at or near zero.

OBJECTS OF THE INVENTION

A broad object of the invention is to provide novel apparatus and method for demagnetizing, in the industrial field.

Another object is to provide apparatus and method of the foregoing character, having features producing the following benefits and advantages: (1) It is effective for demagnetizing pieces of substantially any and all characteristics, including large and massive pieces, as well as small pieces, and hard-steel pieces, as well as soft-iron pieces.

(2) It includes means for selectively predetermining the demagnetizing forces applied to the subject piece, in accordance with the degree of magnetism in the piece.

(3) It includes means for selectively polarizing the demagnetizing force, in an initial step in the demagnetizing, in accordance with polarity of the magnetism in the subject piece, whereby to effectively apply the demagnetizing force counter to the magnetism in the piece.

(4) It includes means for selectively predetermining the magnetizing forces so as to provide longer or shorter periods of reversals, in a given cycle, according to the hardness or softness of the pieces.

(5) It includes means for adjustably varying the voltage of the demagnetizing force applied, so as to accommodate the characteristics of the magnetism of the piece.

(6) It includes means for varying the time period of the demagnetizing cycle, in order to accommodate different magnetism characteristics, such as of hard steel and soft iron.

DESCRIPTION OF A PREFERRED EMBODIMENT

Figure 1:
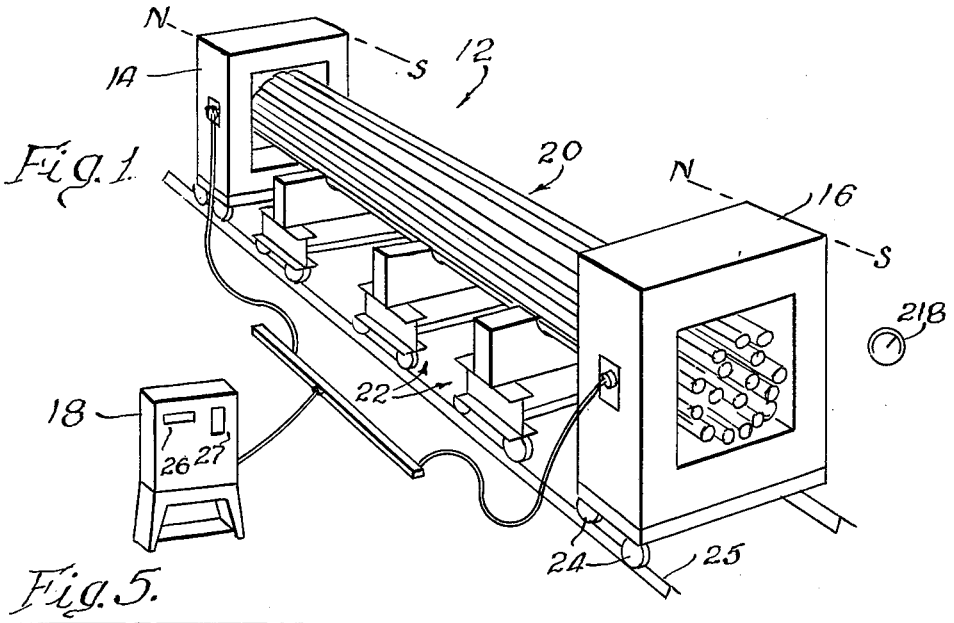
FIG. 1 is a perspective view of the apparatus of the present invention, in position demagnetizing a workpiece.

Referring in detail to the drawings, FIG. 1 shows in perspective, the apparatus of the invention applied to a workpiece which it is desired to demagnetize. The demagnetizing apparatus is indicated in its entirety at 12 and includes as main components, demagnetizing coils 14, 16 and a control and operating unit or control unit 18. The coils 14 and 16 are identical in construction and are shown in the diagram of FIG. 2 at the bottom.

The workpiece to be demagnetized is indicated at 20 and in the present case consists of a bundle of rods, of steel or iron, that is, items that can be, and usually are, magnetized. The present apparatus includes a plurality of bundle support cradles 22 adapted for supporting the bundle of rods. The cradles and magnets are provided with wheels 24 for running on suitable tracks 25. In the use of the apparatus, the coils are backed off longitudinally, the bundle is placed on the cradles, and then the coils run back into place again, around the bundles. These steps are reversed in removing the bundle.

Demagnetizing in the industrial field as a general operation has been known for quite some time. In the industrial field, the magnetization that occurs is usually of high intensity, because of the intense magnetism of the items or workpieces involved, which may be due to the hardness of the material such as hard steel, or the size or massiveness of the workpieces. The magnetism in the workpieces may occur deliberately, or incidentally, as noted. It may occur deliberately in the case of grinding or otherwise treating a workpiece, where the workpiece is held down by magnetism; after the workpiece is treated, it is of course desired to demagnetize it. Magnetism may be produced incidentally, as in a rolling or forming operation in which the pieces are magnetized, as a necessary aspect of the rolling operation, but not desirably so. In either case, whether the magnetism is caused deliberately or incidentally, it is desired to demagnetize the piece. In the present case, the workpiece 20 is made up of a plurality of steel rods. The demagnetizing coils 14, 16 are of the desired size and strength, according to the degree of magnetism in the workpiece, and the factors of hardness of the steel, and the massiveness thereof.

Figure 2:
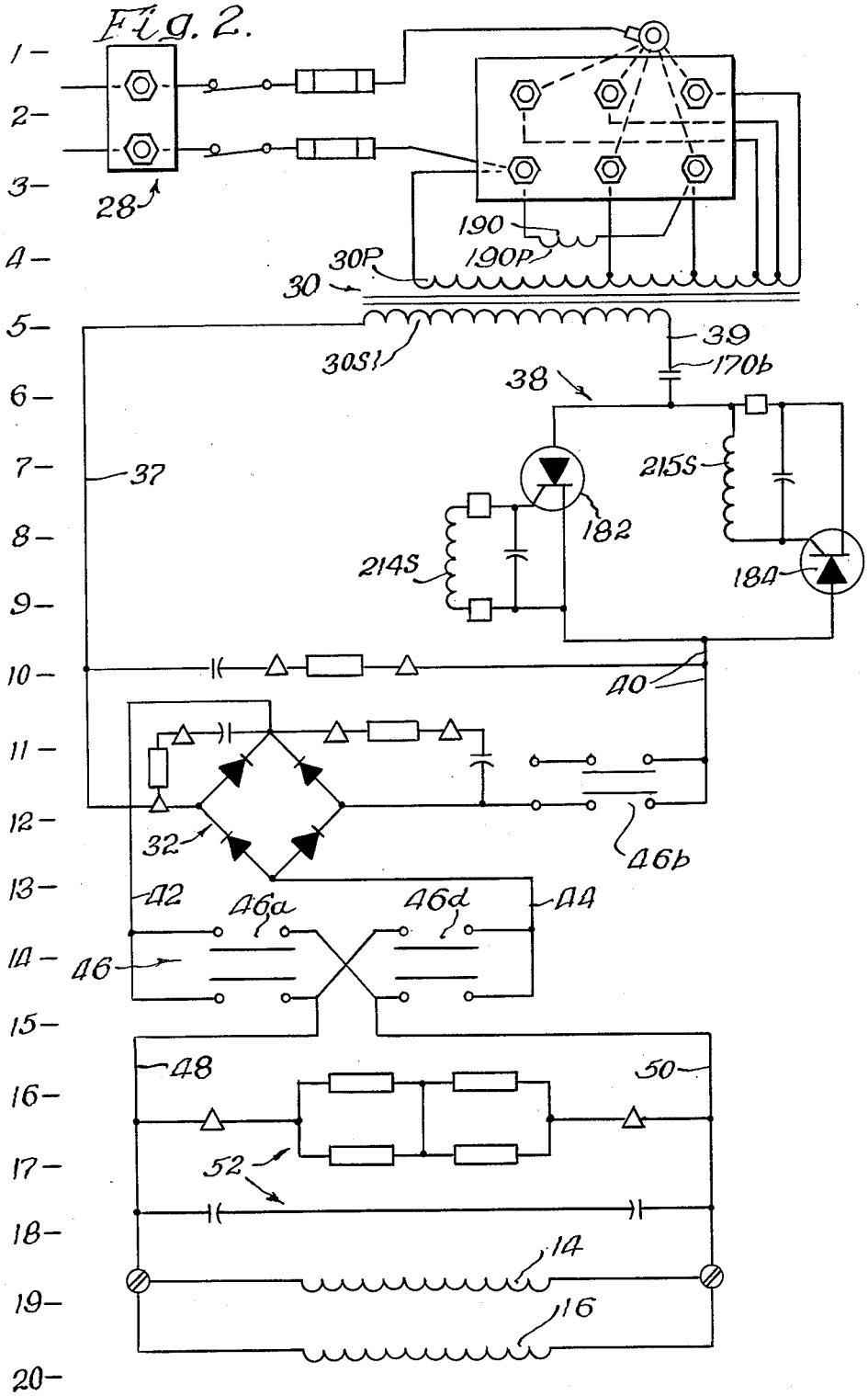
FIG. 2 is a diagram of the power circuit of the apparatus.
Figure 3:
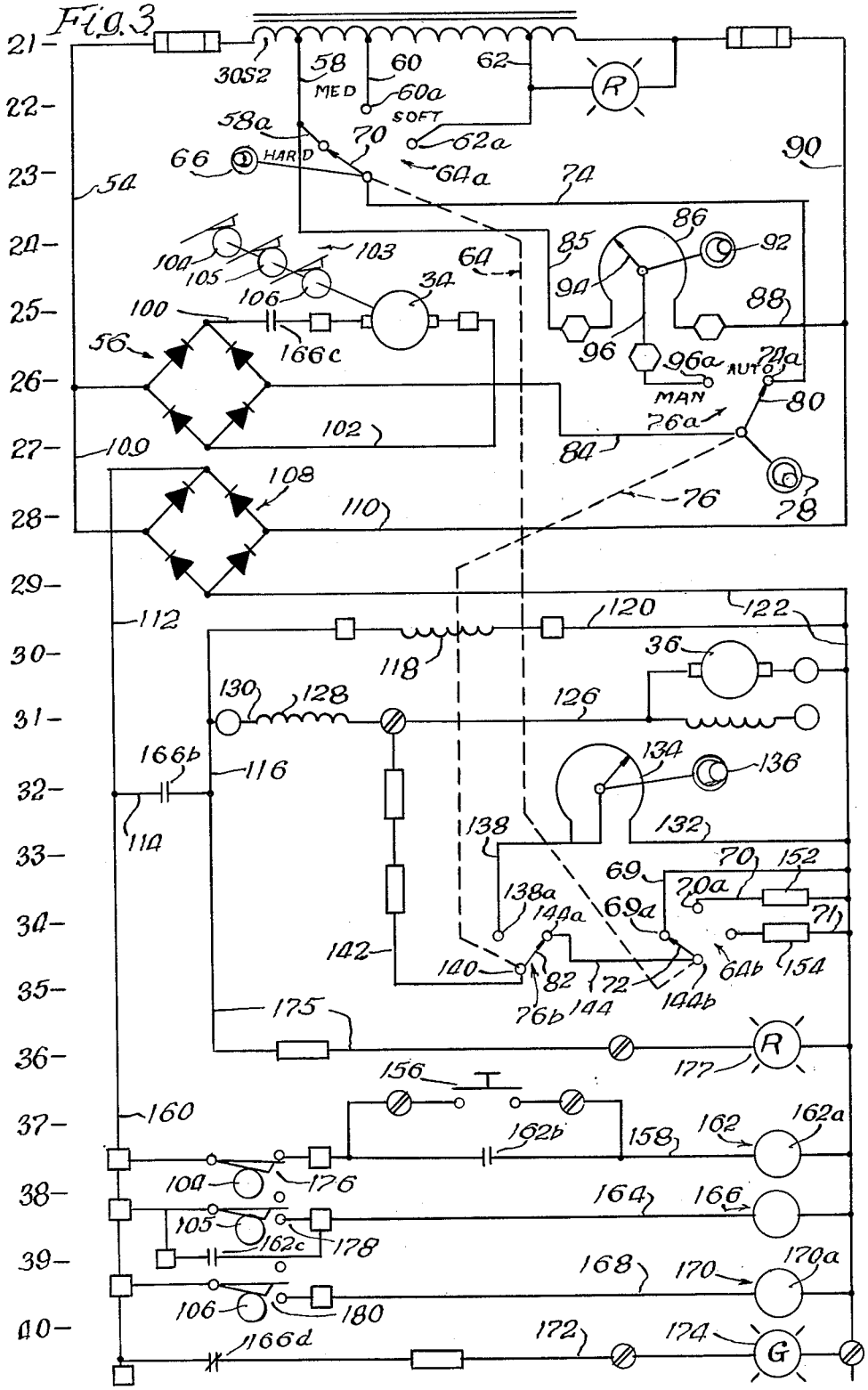
FIG. 3 is a diagram of one portion of the control circuit of the apparatus.
Figure 4:
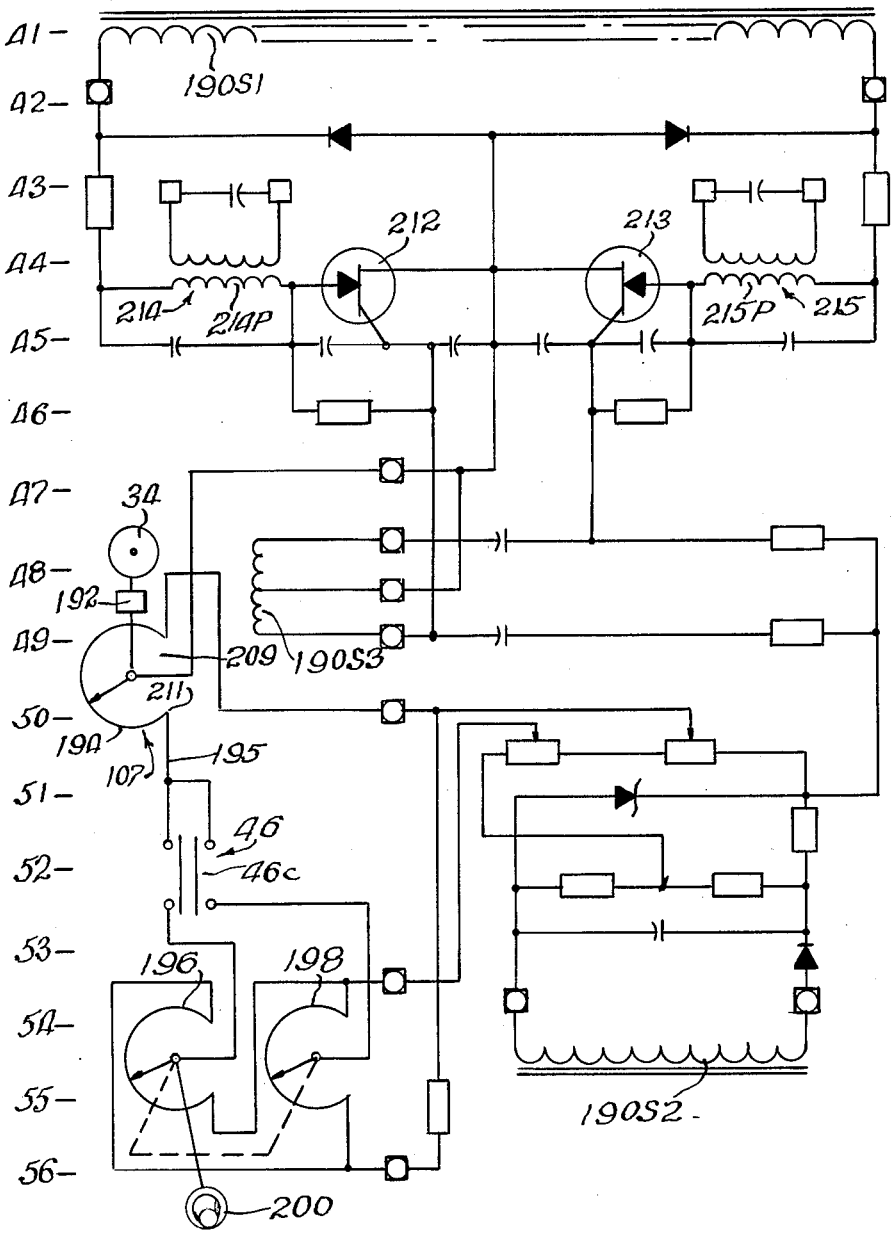
FIG. 4 is a diagram of another portion of the control circuit.

In the electrical circuitry, of FIGS. 2, 3 and 4, the diagrams are provided with line numbers at the left margins thereof to facilitate designating the locations of various elements referred to, these line numbers being given in parenthesis following the references to the corresponding elements in the description thereof.

In the identification of transformers and coils thereof, the transformers as a whole are designated with principal reference numerals, and the primary and secondary coils thereof with the same reference numerals with the postscripts P and S respectively. Similarly, in the case of relays, the relays as a whole are designated with principal reference numerals, while the coils thereof are designated with the same reference numerals and the postscript a and the contacts also with the same reference numerals, but with the postscripts b, c, d, etc.

Figure 8:
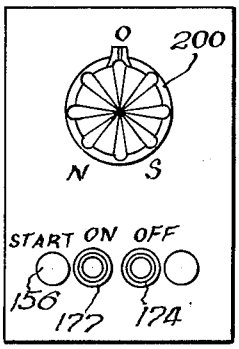
FIG. 8 is a face view of another manual control instrument.
Figure 7:
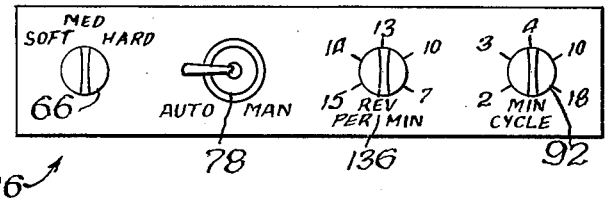
FIG. 7 is a face view of a manual control instrument.

FIG. 7 shows an instrument panel 26 and FIG. 8 an instrument panel 27, which are mounted on the apparatus such as on the component 18 of FIG. 1, and on which are mounted certain control instruments appearing in the electrical circuitry of FIGS. 2, 3 and 4 and referred to in the description of that circuitry.

As an overall and brief summary view, FIG. 2 includes a power circuit, where a suitable AC source is shown at 28 (2), leading to a main power transformer 30 (5), to a rectifier 32 (12), and then to the coils 14, 16 (19) identified above.

For the main control functions, a variable speed motor 34(25,48) provides voltage reduction and operates limit switches, and another variable speed motor 36(30, FIG. 5) provides reversals of polarity.

Referring again to the diagram of FIG. 2, a conductor 37 (7) leads from one side of the transformer to the rectifier 32 (12). At the other side a conductor 39 (5) leads from the transformer to a voltage reduction unit 38 (6), and from that unit a conductor 40 (10) leads to the other side of the rectifier.

In the DC circuit leading from the output of the rectifier 32 (12), are conductors 42, 44 (13) leading to a switch assembly 46 (14) including reversing units 46*a* and 46*d* (see also FIG. 5), and from this reversing switch, conductors 48, 50 lead to the demagnetizing coils 14, 16 identified above. It will be noted that these coils are arranged in parallel in the circuit. Elements identified as a group at 52 (16) are provided for supression of back emf from the coils. The various components of this power circuit of FIG. 2 will be referred to again hereinbelow.

Attention is directed to the portion of the control circuit of FIG. 3. This circuit includes a suitable source of AC, preferably a secondary 30S2 (21) of the transformer 30 (5). From one side of the secondary a conductor 54 leads to one input side of a bridge rectifier 56 (26). Conductors 58, 60, 62 lead from the secondary 30S2 at different tappings thereon, to corresponding terminals 58*a*, 60*a*, 62*a* (23) in a switch means indicated in its entirety at 64 (24) manually actuated by a knob 66 (23) (see also FIG. 7). The switch means 64 includes two ganged units, one 64*a* (23) which includes the contacts 58*a*, 60*a*, 62*a*, and another unit 64*b* (35) having corresponding contacts 69*a*, 70*a*, 71*a* forming terminals of conductors 69, 70, 71. The switch unit 64*a* includes an arm 70 while the switch unit 64*b* includes a similar arm 72. The arm 70 is connected with a conductor 74 which leads to a switch unit 74*a* (26) of a switch means 76 (28) which is manually actuated by a hand knob 78 (see also FIG. 7). The switch means 76 also includes a second unit 76*b* (34). The switch unit 76*a* includes a contact 74*a* in which the conductor 74 terminates, and a pivoted arm 80, while the switch unit 76*b* includes a pivoted arm 82. Leading from the arm 80 is a conductor 84 which leads to the other input side of the rectifier 56.

The conductor 58 (22) continues through a conductor 85 to a potentiometer 86 the other side of which leads through a conductor 88 to a conductor 90 (23) and the secondary 30S2 opposite the conductor 54. The potentiometer 86 is manually adjustable as by a knob 92 (23) (see also FIG. 7). The arm 94 of the potentiometer is connected with a conductor 96 having a contact 96*a* in the switch unit 76*a*. The switch unit 76*a*, as indicated, is manually positionable between MANUAL and AUTOMATIC for performing control corresponding steps referred to hereinbelow.

Leading from the output of the rectifier 56 (26) are conductors 100 and 102, which include the motor 34 identified above, which drives a switch control unit 103 including a plurality of cams 104, 105, 106 which occur again in the circuit (37,38,39) for actuating limit switches there as described hereinbelow. It also drives the voltage reduction means indicated generally at 107 (49) of FIG. 4, also as referred to again hereinbelow.

The control circuit of FIG. 3 includes a second rectifier 108 (28), the input of which is connected with conductors 109 leading from the conductor 54, and 110 leading from the conductor 90, and both thus leading from the secondary 30S2.

Leading from one side of the output of the rectifier 108 is a conductor 112 which leads to a conductor 114 (32) and then to a conductor 116 and a coil 118 (30) constituting the motor field of the motor 34. From the other side of the coil 118 is another conductor 120 leading to a return conductor 122 which leads to the other side of the output of the rectifier 108.

The polarity reversing motor 36 (30) is included in a conductor 126 which leads from the conductor 122, and includes a coil 128 constituting the motor field of the motor 36, another conductor 130 completing the circuit through that coil, leading to the conductor 116.

Leading from the conductor 122 is a conductor 132 (33) which leads to a potentiometer 134, manually actuated by a knob 136 (also FIG. 7), the potentiometer continuing through a conductor 138 terminating in a contact 138*a*, in the switch unit 76*b*. The conductor 82 of this switch unit is pivoted at 140 and connects with a conductor 142 returning to the conductor 126. The switch unit 76*b* includes another contact 144*a* forming a terminal in a conductor 144 which has another contact 144*b* connected with the arm 72 in the switch unit 64*b*. The conductors 70, 71 include resistances 152, 154, respectively, of different values while the conductor 69 does not include a resistance, for use in controlling the speed of the motor 36 (30), as explained hereinbelow in the operation and functioning of the switches 64, 76.

The circuit of FIG. 3 at the bottom thereof includes various relays and similar controls which are now identified briefly and which will be referred to again hereinbelow. A start switch 156 (36) (see also FIG. 8) is included in a conductor 158 connected between the conductors 122 and 160. The conductor 158 includes a relay 162 having holding contacts 162*b* and contacts 162*c* (39), the latter being in a conductor 164. In the conductor 164 is a relay 166 having contacts 166*b* (32), 166*c* (25) and 166*d* (40). An additional conductor 168 (39) includes a relay 170 including contacts 170*b* (6). Additionally, another conductor 172 (40) includes a green light 174, and a further conductor 175 (36) is connected between the conductors 114, 112, and the conductor 122, and includes a red light 177.

Additionally, the circuit of FIG. 3 at the lower portion thereof includes limit switches 176, 178, 180, (37, 38, 39) in the conductors 158,164, 168, respectively, which are actuated by the cams 104, 105, 106 as driven by the voltage reduction motor 34 (25). These limit switches are actuated in a predetermined timing cycle, represented in FIG. 6, and referred to again hereinbelow, and as will be brought out in that detail description, the timing cycle is controlled by the motor 34, which in turn is controlled by manual settings.

The diagram of FIG. 4 transmits signals and control from that of FIG. 3 to the power circuit of FIG. 2. The circuit of FIG. 4 acts partially through the voltage reduction unit 38 (6). That unit includes back-to-back SCRs 182, 184 which are controlled as described hereinbelow. As noted above, the unit 38 is connected between conductors 39, 40, and it is pointed out that the conductor 39 includes the relay contacts 170*b*.

The circuit of FIG. 4 includes a secondary 190S1 (41) leading from a primary 190P (4) which is connected with the AC source 28 (2) at suitable tappings therein, such as at 230V. The transformer 190 also includes secondaries 190S2 (55) and 190S3 (48), in the circuit of FIG. 4. The motor 34 (25, 48) operates through a suitable component 192 (48) which includes a speed reducer for driving a potentiometer 194 (49) included in the voltage reduction means 17. A conductor 195 leads from the potentiometer to a reversing unit 46*c* of the switch assembly 46 (FIG. 5) and then to a pair of supplementary potentiometers 196, 198 ganged for conjoint manual actuation by a knob 200 (see also FIG. 8). Upon the switch unit 46*c* changing positions, and correspondingly being placed in respective reversing positions, the potentiometers 196, 198 are added to, or subtracted from, the effectiveness of the potentiometer 194 in applying the magnetic field of the demagnetizing magnets to the workpiece. This step of the operation will be referred to again hereinbelow.

Figure 5:
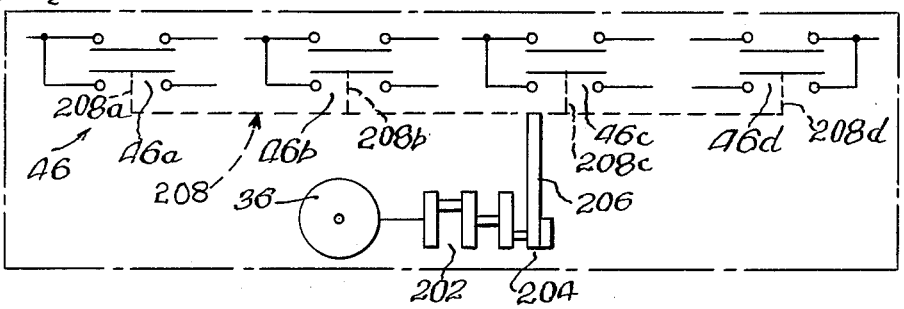
FIG. 5 is a schematic view of the motor actuated power contactor utilized in the apparatus.

The circuit interruption and reversal steps are controlled by the switch means of 46 FIG. 5, which includes four switches or units 46*a*, 46*b*, 46*c*, 46*d*, appearing elsewhere in the drawings, and referred to in connection therewith. This figure includes the motor 36 (30) which acts through a speed reducer 202 having a crank 204 and driving a pitman 206. The pitman is connected with a bar 208, having extensions 208*a*, 208*b*, 208*c*, 208*d* connected with the individual switch units of the switch assembly. Upon rotation of the motor 36, the switch units are moved to opposite positions in each half-rotation of the crank 204, a complete revolution of the crank 204 representing two cycles, that is, the advancing movement of the crank, upwardly as viewed in FIG. 5, produces one cycle, and the retracting movement produces a cycle. In each movement, the switch units 46*b* (12) and 46*c* (52) in the AC are opened, and after these are opened the switch units 46*a*, and 46*d* (14) in the DC circuit to the chuck are opened, and are closed in the opposite position, or reversed, while the AC is still interrupted, and thereafter, the switch units 46*b* and 46*c* in the AC are closed in the opposite position. All of the switch units are actuated in unison, by the single common bar 208 (FIG. 5) AC switch units 46*b*, 46*c* re-establishing the AC in both of their positions, the arrangement enables all of the switch units to be actuated by a single actuator. The arrangement prevents arc-ing as would occur by breaking the DC circuit directly, but instead, in the present instance, the AC circuit is first interrupted and then when it is broken, the switches 46*a*, 46*d* in the DC are opened. The switch 46*c* in the switch assembly 46, as noted above, is interposed (52) between the motor-driven potentiometer 194 and the two manually adjustable potentiometers 196, 198. This switch unit in its opposite positions, connects the potentiometers 196, 198 alternately in circuit with the potentiometer 194.

In the operation of the circuit of FIG. 4, the potentiometer 194 (49) extends about 270°, leaving a gap 209, and the arm 210 therefor is rotated steadily by the motor 34 having a starting or neutral position 211. The speed of the motor was referred to above and will be referred to again hereinbelow. In the operation of the control circuit position of FIG. 4, the seccondary 190S3 (48) provides gating control on SCRs 212, 213, (44), controlling the energizing of transformers 214, 215, the secondaries of which are found in the control unit 38 (7) of FIG. 2 where they respectively control the back-to-back SCRs 182, 184 (8) identified above. The SCRs 182, 184 are fired at progressively later angles in the AC cycle, under the control of the SCRs 212, 213 and effectively reduce the AC to the rectifier 32 (12), and thus reduce the DC to the coils 14, 16 (19).

Upon initiation of the demagnetizing cycle, the motor 34 (25, 47) begins to run and drive the potentiometer 107, gradually increasing the resistance and reducing the current to the SCRs 212, 213 (44) and in turn the SCRs 182, 184 (8), resulting in reduced current to the rectifier 32 (12) as stated. The voltage reduction unit 38 incorporating the SCRs 182, 184 provides for interrupting the full voltage source, as a relatively less costly and more efficient method of interrupting the current to the rectifier 32.

The potentiometers 196, 198 (54) as mentioned above are added to or subtracted from the potentiometer 194. The resistances of the potentiometers 196, 198 are very small relative to the basic value of the potentiometer 194 and the additive or subtractive values are correspondingly small.

In the demagnetizing operation, the operator first determines the polarity of the workpiece 20 by means of a magnetic field indicator 218 (FIG. 1), holding it at one end of the workpiece. Assuming that the end concerned, the near end of FIG. 1, is the south pole, the knob 200 (56) (see also FIG. 8) is set to the same indication, i.e., south. This sets the two potentiometers 196, 198 in corresponding position and orientation relative to the potentiometer 194 so that the first pulse of magnetic field of the demagnetizing coil is counter to the polarity of the workpiece. This relationship produces an initial effective step in first imposing the demagnetizing field counter to the magnetism of the workpiece. In the reversing operations, in the step-by-step reversals (see below), the switch 46*c* (52) is reversed, the potentiometers 196, 198 are alternately and successively put in series with the potentiometer 107, one added to it, and the other applied in counter direction, or subtracted.

Figure 6:
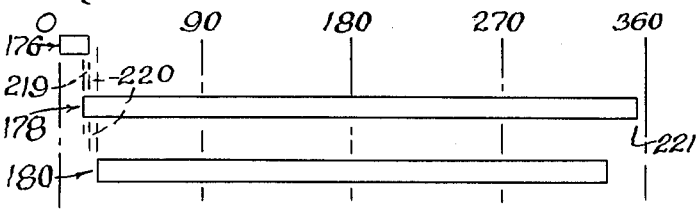
FIG. 6 is a timing chart on the limit switches.

In initiating the demagnetizing operation, the operator closes the start switch 156 (36) energizing the relay 162, the latter being held through the contacts 162*b*. The limit switch 176 is at that time in closed position. The energization of the relay 162 closes the contacts 162*c* (39) and energizes the relay 166 and thereby closes the contacts 166*c* (25) to the armature of the motor 34. Also it closes the contacts 166*b* (32) energizing the motor field 118 (30) of the motor 34 which then drives the cams 104, 105, 106, actuating the limit switches 176, 178, 180 (37,38, 39). FIG. 6 shows the time periods of the closure or active positions of the limit switches: the switch 176 is closed only for a short moment; before that switch is opened, the switch 178 is picked up and closed as indicated by the spacing of the lines 219. After the switch 176 is opened, the switch 180 is closed, as indicated by the spacing of the lines 220. The motor 34 thus energized and running, in addition to driving the potentiometer 107 through its course, as stated above, actuates the limit switches determining the demagnetizing cycle.

On energization of the relay 166 (38), and consequent closure of the contacts 166*b* (32), the polarity reversing motor 36 (30) is also energized, and this motor as represented in FIG. 5 and described above, drives the switch assembly 46 (FIG. 5). Upon the approaching the end of its course, the limit switch 178 (38) is the last to open as indicated at 221 in FIG. 6, and the cycle is then completed.

In the position represented at FIG. 3, the apparatus is in AUTOMATIC mode, as indicated by the setting of the switch 76 (28). The circuit then leads from the secondary 30S2 (21), through the switch unit 64*a* (23), the switch unit 76*a* (26) to the rectifier 56 (26). If the workpiece is for example of hard steel, the switch 64*a* is set in HARD position, and for soft materials it may be set in MED (medium) position or in SOFT position. This positioning of the switch means connects the secondary 30S2 (21) at corresponding voltage tap positions, and the motor 34 is driven at a corresponding speed.

The switch unit 64*a* is set by the manual knob 66 which sets the complete switch assembly 64, and thus the switch unit 64*b* (34) is also set in the corresponding position, and in the settings of the switch unit 64*b*.

The corresponding conductors 69, 70, 71 are put in circuit respectively, without a resistance, or with resistances 152, 154, and accordingly the motor 36 (30) is driven at corresponding speeds. Thus upon driving the voltage reduction motor 34 at a slower or faster speed, the polarity reversing motor 36 is driven at a corresponding faster or slower speed. The motor 34 determines the time period of the demagnetizing cycle, and thus in a faster speed of the cycle, the reversals are made correspondingly fast. Hard steel requires longer time for demagnetizing, and in some cases, a time period of 18 minutes, for example, may be desired. In other cases, a short period, as short as 4 minutes, may be desired. Other periods between those extremes can of course be set.

The demagnetizing steps above described take place when the apparatus is set at AUTOMATIC. If it is desired to operate it under manual control, the switch 76 (26) is thrown to such MANUAL position. In that case the switch 64 (23) is bypassed, and the circuit from the secondary 30S2 (21) leads through the conductors 58, 85, potentiometer 86, conductor 96 and then the conductor 84 to the rectifier 56. In a corresponding manner with the switch unit 76*b* set in MANUAL position, the circuit through the potentiometer 134 (32) is conductor 132, conductor 138, the switch unit 76*b*, conductor 142, field 128 of the motor 36, conductor 130 and conductor 114. The potentiometer 134 as noted is manually settable by the knob 136, and is set to produce the desired speed of the motor 36, and thus the number of reversals of the switch assembly 46. In such MANUAL setting, the motors 34, 36 are independently controlled and hence the number of reversals is accordingly independent of the time period of the voltage reduction.

Upon the voltage reduction motor 34 running its course, and the opening the switch 178, the time cycle is terminated.

We claim:

1. Demagnetizing apparatus comprising, circuitry adapted for connection with a source of current and operably interconnecting the components hereinafter set out, one of the components including demagnetizing coils, the circuitry being operable for transmitting DC to the demagnetizing coils, the coils being adapted for cooperation with a magnetized piece and operable for demagnetizing the piece, voltage reducing means operable through a range from a condition enabling full voltage to be applied to the coils to a condition in which substantially zero voltage is so applied, polarity reversing means operable through a predetermined range and including reversing switch means for reversing the DC in successive reversals throughout its range, cycling means operable through a predetermined range, for operating the voltage means and the polarity reversing means, and adjusting means for adjustably varying the range of each the voltage reducing means and the polarity reversing means independently of the cycling means.

2. Demagnetizing apparatus according to claim 1 wherein, the adjusting means includes manually settable means for adjusting the range of the voltage reducing means from longer to shorter and correspondingly adjustably reducing the number of reversals of the polarity reversing means.

3. Demagnitizing apparatus according to claim 2 wherein, the voltage reducing means and polarity reversing means include variable speed electric motor means, and the adjusting means is operable for controlling resistance to the motor means, for thereby adjusting said ranges.

4. Demagnetizing apparatus according to claim 18 wherein, the circuitry includes a rectifier producing DC which the circuitry is operable for transmitting to the demagnetizing coils, the voltage reducing means includes a variable speed electric motor, the circuitry includes SCR's for controlling the rectifier, and the circuitry includes variable resistance driven by the electric motors for correspondingly adjusting the current to the SCR's and thereby to the rectifier and sonsequently to the demagnetizing coils.

5. Demagnetizing apparatus according to claim 4 and including, supplementary resistances for respectively adding to and subtracting from the value of the variable resistance alternately in successive reversals.

6. Demagnetizing apparatus according to claim 5 wherein, the supplementary resistances are manually settable in value, relative to the value of the variable resistance.

7. Demagnetizing apparatus according to claim 1 wherein, the circuitry includes transformer means, the means for varying the voltage reducing means includes means for tapping the transformer means at different value tappings, and the means for varying the reversing means includes resistances of different values selectively introduced in circuit with the reversing means.

8. Demagnetizing aparatus according to claim 1 wherein, the cycling means includes rotating means movable through a predetermined number of revolutions in a cycle, and the adjusting means includes means for varying the speed of rotation through that predetermined number of revolutions.

9. Demagnetizing apparatus according to claim 2 wherein, the circuitry includes means for manually setting to automatic and to manual mode, and when in automatic mode operable as stated, and the circuitry includes means operable when in manual mode for independently and individually manually setting for predetermining the time of a cycle of the cycling means.

10. Demagnetizing apparatus according to claim 9 wherein, the circuitry includes means independent of the cycling means for predetermining the maximum level of the voltage applied to the coils.

11. Demagnetizing apparatus according to claim 9 wherein, the circuitry includes means independent of the cycling means for predetermining the rate of reversals of polarity throughout a cycle.

* * * * *